US009180690B2

(12) United States Patent
Moore et al.

(10) Patent No.: US 9,180,690 B2
(45) Date of Patent: Nov. 10, 2015

(54) SYSTEM AND METHOD FOR DECURLING MEDIA IN A PRINTING SYSTEM

(75) Inventors: Steven R. Moore, Pittsford, NY (US); Marina Tharayil, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 448 days.

(21) Appl. No.: 13/023,121

(22) Filed: Feb. 8, 2011

(65) Prior Publication Data

US 2012/0201590 A1 Aug. 9, 2012

(51) Int. Cl.
*B41J 11/00* (2006.01)
*B65H 23/34* (2006.01)

(52) U.S. Cl.
CPC ..... *B41J 11/0005* (2013.01); *B65H 23/34* (2013.01); *B65H 2301/51256* (2013.01)

(58) Field of Classification Search
CPC ..... B65H 23/34; B65H 29/70; B65H 2301/51256; B41J 11/0005; B41J 13/10; G03G 2215/00662
USPC ..... 400/613.3, 638, 639, 642; 271/188, 271/209, 161; 399/406
See application file for complete search history.

(56) References Cited

U.S. PATENT DOCUMENTS

| | | | | |
|---|---|---|---|---|
| 4,926,358 | A * | 5/1990 | Tani et al. | 700/302 |
| 5,454,556 | A | 10/1995 | Siegel | |
| 6,908,189 | B2 * | 6/2005 | Miyamoto et al. | 347/102 |
| 7,431,278 | B2 * | 10/2008 | Hiraki et al. | 271/3.14 |
| 7,545,519 | B2 | 6/2009 | Ossman et al. | |
| 7,548,316 | B2 | 6/2009 | Castillo et al. | |
| 2009/0085947 | A1 * | 4/2009 | Kado et al. | 347/16 |
| 2009/0256896 | A1 * | 10/2009 | Scarlata | 347/101 |
| 2010/0086338 | A1 * | 4/2010 | Hara et al. | 399/406 |

* cited by examiner

*Primary Examiner* — Jennifer Simmons
(74) *Attorney, Agent, or Firm* — Hoffmann & Baron, LLP

(57) ABSTRACT

Embodiments described herein include an upstream measurement module, a curler downstream of the upstream measurement module, and a print station downstream of the curler. The upstream measurement module includes a transport on which media is tacked to flatten the media and a curl sensor to generate a curl signal corresponding to a media curl of the media on the transport. The curler curls the media in response to the curl signal to reduce a magnitude of the media curl. The print station includes a marking unit to dispose a marking material on the media and a transport to transport the media past the marking unit, wherein the first and second transports apply a substantially equivalent hold down force to the media.

20 Claims, 4 Drawing Sheets

SYSTEM AND METHOD FOR DECURLING MEDIA IN A PRINTING SYSTEM

BACKGROUND

1. Technical Field

The presently disclosed embodiments are directed to identifying and/or compensating for substrate media edge curl in a printing system.

2. Brief Discussion of Related Art

In production printers using direct marking technology, it is expected that solid inks and ultra violet (UV) gel inks that are jetted directly onto cut sheet media will become increasingly popular. A critical print process parameter for some direct marking printing systems is the print head to substrate media gap, which refers to a distance between print nozzle ejection surface of a print head and the substrate media. In some printing systems, the gap is set to as little as 0.5 millimeter (mm) to minimize the pixel placement errors due to misdirected ink droplets.

These tight printhead to media gaps pose a serious challenge for direct marking printing system, since the lead edge (LE) and trail edge (TE) of the media, and to a less extent the body of the media, are generally not perfectly flat as the media pass by the print heads. For accurate pixel placement and color registration, the print head-to-media gap is desirably kept within about a +/−0.1 mm range about the nominal gap distance. To avoid printhead front face damage, the media must not be allowed to 'close the gap' and contact the printhead. Vacuum and electrostatic transport belt technologies are capable of holding down cut sheet media as the media pass the print heads. However, neither technology is typically robust against lead edge and trail edge curl, which refers to substrate media curvature towards the print head and away from the media transport.

SUMMARY

According to aspects illustrated herein, there is provided a printing system. The printing system includes an upstream measurement module, a curler, and a printing station. The upstream measurement module includes a first transport on which media is tacked to flatten the media and a first curl sensor to generate a first curl signal corresponding to a media curl of the media on the first transport. The curler is downstream of the upstream measurement module and curls the media in response to the first curl signal to mitigate an effect of the media curl in the printing system. The print station is downstream of the curler and includes a second transport to transport the media passed the printing station. The first and second transport can apply a substantially equivalent hold down force to the media.

According to other aspects illustrated herein, there is provided a curl control system for use in a printing system. The curl control system includes a first transport, a first curl sensor, and a curler. The media is tacked to the first transport to flatten the media. The first curl sensor to generate a first curl signal corresponding to a magnitude of a media curl of the media on the first transport. The curler changes the magnitude of the media curl in response to the first curl signal.

According to other aspects illustrated herein, there is provided a method of pre-curling media in a printing system. The method includes tacking media to a first transport to flatten the media on the first transport, measuring a magnitude of a media curl of the media on the first transport to generate a first curl signal, and curling the media to change the magnitude of the media curl in response to the first curl signal.

DETAILED DESCRIPTION

Figure 1:
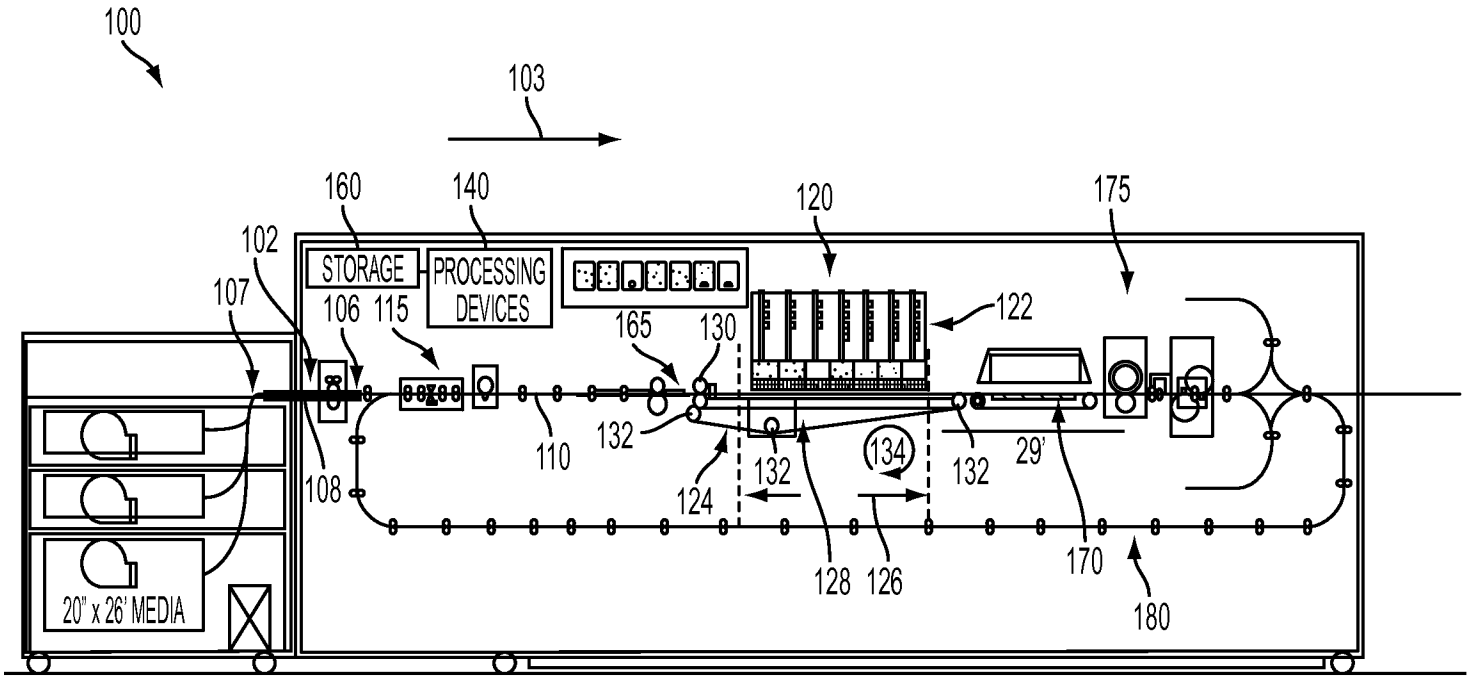
FIG. 1 shows an exemplary direct marking printing system.

Exemplary embodiments are directed to pre-curling cut sheet substrate media to eliminate and/or reduce media curl by inducing down-curl in the media in response to detection of media curl. The amount of down-curl applied to the media can be adjusted based on the magnitude of the media curl. Exemplary embodiments can include a curl control system having a curl measurement module upstream and downstream of a curler. Embodiments of the curl measurement modules can hold the media down to simulate, replicate, mimic, and the like, the print zone hold down transport and can measure media flatness. The upstream curl measurement module can therefore provide a functional prediction or 'sneak preview' of media flatness in the print zone if no down-curl is applied by the curl control system. The downstream measurement module can provide a final look at the expected flatness of the media after down-curl is applied to the media.

As used herein, a "printing system" refers to a device, machine, apparatus, and the like, for forming images on substrate media and a "multi-color printing system" refers to a printing system that uses more than one color (e.g., red, blue, green, black, cyan, magenta, yellow, clear, etc.) marking material to form an image on substrate media. A "printing system" can encompass any apparatus, such as a digital copier, bookmaking machine, facsimile machine, multi-function machine, etc., which performs a print outputting function. Some examples of printing systems include Direct-to-Paper or Direct Marking, ink jet, solid ink, as well as other printing systems. A "direct marking printing system" refers to a printing system that disposes a marking material directly on substrate media.

As used herein, "sensor" refers to a device that responds to a physical stimulus and transmits a resulting impulse or signal for the measurement and/or operation of controls. Such sensors include those that use pressure, light, motion, heat, sound, capacitance, magnetism, tactility, and the like. A sensor can include one or more point sensors and/or array sensors for detecting and/or measuring characteristics or parameters in a printing system, such as a distance between substrate media and a print head, a distance from a transport belt to a highest point of a media curl, and the like. As used herein, a "curl sensor" refers to a sensor for detecting curls in substrate media by, for example, detecting a height of substrate media with respect to a reference surface, such as a media transport and/or a face of a marking unit.

As used herein, "marking material" refers to a substance, such as "ink" and "toner", that can be disposed on substrate media to form images. While ink is generally stored in a liquid form and toner is generally stored in a solid form, ink and/or toner can be stored in various forms. For example, ink can be stored in a liquid form or a solid form.

As used herein, "process direction" refers to a direction in which substrate media is processed through a printing device and "cross-process direction" refers to a direction substantially perpendicular to the process direction.

As used herein, "downstream" refers to location of an object relative to a location of another object with respect to the process direction, wherein an object is downstream from another object when it is encountered by media after the other object in the process direction.

As used herein, "upstream" refers to location of an object relative to a location of another object with respect to the process direction, wherein an object is upstream from another object when it is encountered by media before the other object in the process direction.

As used herein, "substrate media" or "media" refers to a tangible medium, such as paper (e.g, a sheet of paper, a long web of paper, a ream of paper, etc.), transparencies, parchment, film, fabric, plastic, or other substrates on which an image can be printed or disposed.

As used herein, an "image" refers to a visual representation, reproduction, or replica of something, such as a visual representation, reproduction, or replica of the contents of a computer file rendered visually on a belt or substrate media in a printing system. An image can include, but is not limited to: text; graphics; photographs; patterns; pictures; combinations of text, graphics, photographs, and patterns; and the like.

As used herein, a "media transport" or "transport" refers to a component and/or assembly in a printing system, such as a belt, multiple parallel belts, a moving rigid platen, and the like, for transporting or carrying substrate media in the printing system.

As used herein, "rollers" refer to shafts, rods, cams, and the like, that rotate about a center axis. Rollers can facilitate rotation of a belt about the rollers and/or can form nips through which media passes.

As used herein, "transporting" or "transport" refers to carrying and/or moving an object or thing, such as media, from location to another location.

As used herein, a "printing station" refers to a section in a printing system that disposes, transfers, forms, or otherwise generates an image on media.

As used herein, a "marking unit" refers to a unit for disposing, forming, transferring, or otherwise generating an image on a belt or media, and a "direct marking unit" refers to a marking unit that disposes marking material directly on media.

As used herein, a "processing device" refers to a processor or controller for executing commands or instructions for controlling one or more components of a system and/or performing one or more processes implemented by the system.

As used herein, a "computer storage device" refers to a device for storing computer files, instructions, and the like, and can include computer readable medium technologies, such as a floppy drive, hard drive, compact disc, tape drive, Flash drive, optical drive, read only memory (ROM), random access memory (RAM), and the like.

As used herein, a "curl" or "media curl" refers to a portion of media that deflects away from a reference surface, such as a transport belt. For example, a portion of a sheet of media can deflect away from a transport belt to which it is tacked while an adjacent portion of the media is in contact with the transport belt.

As used herein, a "curl control system" refers to a system implemented to detect, measure, or otherwise identify curls in media and to decurl the curls.

As used herein, a "curler" refers to a system to decurl media to reduce and/or eliminate curls in the media.

As used herein, "curling", to "curl", "decurling", or to "decurl" refers to applying a curl to media by the curler, for example, to mitigate an effect a detected curl has in a printing system.

As used herein, "measurement module" refers to a system to detect, identify, measure, estimate, and the like, curls in media, an "upstream measurement module" refers to a measurement module disposed upstream of a curler, and a "downstream measurement module" refers to a measurement module disposed downstream of a curler.

As used herein, "tack" refers to holding, attracting, fixing, and the like, one object or thing to another object or thing. For example, holding, attracting, or fixing media to a surface of a transport, such as a surface of a belt or platen of the transport, by a hold down force.

As used herein, "flat" refers to lying substantially on or against something. For example, media, or a portion thereof, can lie substantially flat on a transport surface.

As used herein, "flatten" refers to making an object or thing flat, and "flatness" refers to a measure of how flat something becomes when flattened. For example, a hold down force can be used to make at least a portion of a sheet of media lie flat on a transport surface so that the media has a particular flatness, which is referred to herein as "media flatness".

As used herein, "down-curl" refers to a curl towards a reference surface, such as a transport surface, and/or to a process of curling media towards a reference surface, such as a transport surface on which the media is supported.

As used herein, "indentation settings" refer to parameters used to configure a curler to decurl media.

As used herein, "estimate" or "estimation" refers to an approximation of a value of something. For example, an approximation of the magnitude of a media curl with respect to a transport belt, an approximation of a magnitude of a media curl in one section of a printing system based on a magnitude of the media in another section of the printing system, and the like.

As used herein, "measuring" refers to determining and/or identifying an extent, dimensions, and the like, of something, ascertained by, for example, comparison with a standard unit of measurement, such as a meters and/or feet.

As used herein, "detect" refers to identifying and/or recognizing an occurrence, event, object, and the like.

As used herein, "magnitude" refers to a size, extent, dimensions, and the like of something, such as a distance between two points. For example, a curl height measured from a transport belt to a top of a media curl and/or a media-to-marking unit (or marking unit-to media) gap, which refers to a distance between the media and at least one marking unit.

As used herein, "reduce" refers to decreasing or minimizing

As used herein, "mimic" refers to replicating, copying, simulating, and the like, a first thing or object using second thing or object so that the second thing or object behaves, acts, operates, performs, and the like, substantially like the first.

As used herein, "exception processing" refers to performing a process that is different then a normally performed process in response to a detected event.

As used herein, "hold down technologies" refers to types of hold down mechanisms, such as electrostatic or vacuum, that can be used to tack media to a transport surface.

As used herein, "hold down force" refers to an influence on media to urge the media towards a reference surface, such as a transport belt, to tack the media to the reference surface.

As used herein, "corresponding" refers to related, associated, and/or correlated things or objects, such as possible curl magnitudes and indentation settings.

FIG. 1 is an exemplary direct marking printing system 100, such as an ink jet printing system. The printing system 100 can have a transport path 110, a curl control system 115, a printing station 120, one or more processing devices 140, and a computer storage device 160. The printing system 100 can also include a pre-heating zone 165 upstream of the printing station to heat the media before printing, a post-printing transport 170, a fixing nip 175 to fix material disposed on the media to its final film thickness, and duplex path 180 to return media for side 2 printing.

The transport path 110 is the path along which cut sheet media 102 (hereinafter "media 102") is transported through the printing system 100 in the process direction 103. The media 102 can have a leading edge 106, a trailing edge 107, and a body 108. The printing system 100 can process the media 102 using the curl control system 115 to decurl the media 102 when media curl is detected and can subsequently print an image on the media as the media passes through the printing station 120. The printing system 100 can detect media curl of the media before printing on the media and can determine the amount of down-curl to apply to the media to reduce and/or eliminate the media curl.

The printing station 120 can include direct marking units 122 (hereinafter "marking units 122") and a media hold down transport 124, which form a printing zone 126. The marking units 122 can be implemented as print heads having print nozzles through which marking material, such as ink, is ejected. In some embodiments, the printing system 100 can be a multi-color printer and the marking units 122 can dispose different color marking material on the media.

The media hold down transport 124 can include a driven transport belt 128 and a tack roller 130. The transport belt 128 can be supported by rollers 132 and can be driven to rotate in a clockwise direction illustrated by arrow 134 to transport media through the printing zone 126 in the process direction so that the media passes the marking units 122 of the printing system 100. The media transport belt 128 can be implemented to hold down or tack the media to the belt 128 as the media passes the marking units 122. The transport belt 128 can be implemented to apply a tack pressure or hold down force to a backside of media to hold the media in place. The hold down transport 124 operates to keep media 102 sufficiently flat from edge to edge. Small departures, such as more than 0.1 mm in local flatness variation, can induce a pixel placement error that can cause an image quality defect. Larger departures, for example greater than about 0.5 mm in local flatness can cause contact between media and the marking units 122. This is undesirable since media particles could be forced into nozzles of the marking units 122 and any anti-wetting coating on the marking units 122 can be damaged. The tack roller 130 can be positioned at an incoming end of the transport belt 128 and can engage the belt 128 to form a nip through which the media 102 can pass. The tack roller 130 can operate to ensure the media 102 is properly tacked to the transport belt 128.

In some embodiments, the media transport belt 126 can be an electrostatic transport belt that uses electrostatic charge to attract the media to the electrostatic transport belt. The electrostatic charge causes the media to adhere or tack to the media transport belt to inhibit movement of the media during the printing process. While the media is on the electrostatic transport belt, the media typically does not shift unless a force is applied to the media overcoming the force of attraction resulting from the electrostatic charge and/or the electrostatic charge is removed. Thus, the media typically does not shift while it is disposed on the electrostatic transport belt.

In some embodiments, the media transport belt 126 can be a vacuum transport belt that uses suction to hold the media in place on the vacuum transport belt. The suction causes the media to adhere or tack to the media transport belt to inhibit movement of the media during the printing process. While the media is on the vacuum transport belt, the media typically does not shift unless a force is applied to the media overcoming the force of attraction resulting from the suction and/or the suction is removed. Thus, the media typically does not shift while it is disposed on the vacuum transport belt.

Figure 2:
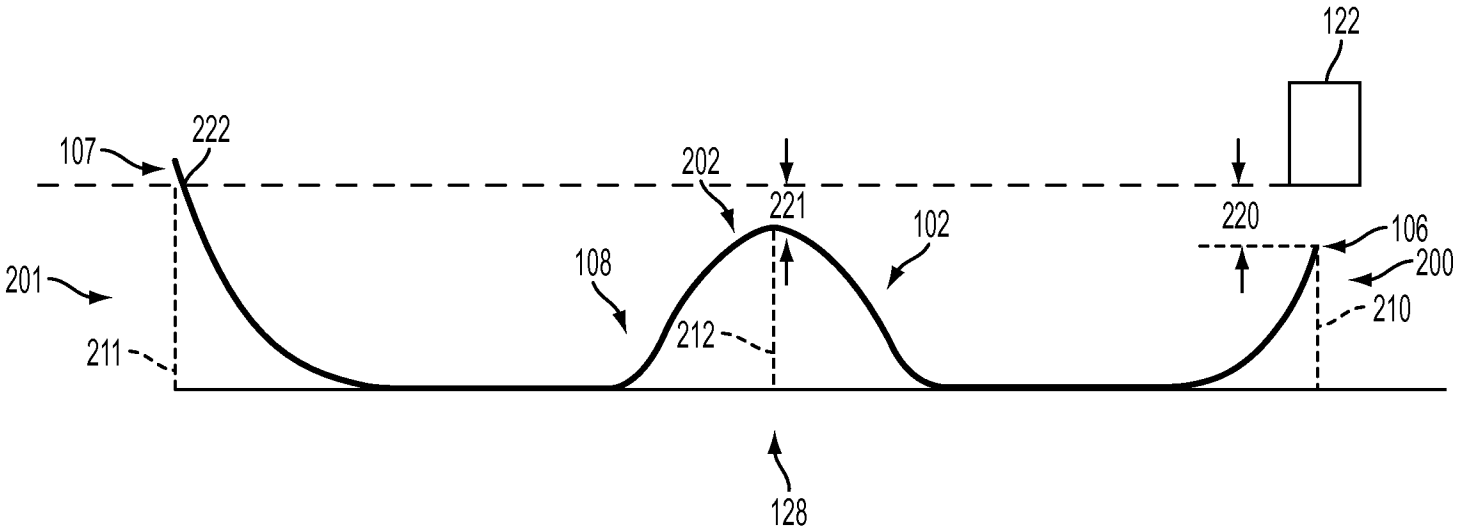
FIG. 2 is exemplary diagram illustrating exemplary media curls that can occur when media is tacked to a transport.

In some instances, the hold down force applied to the media by the transport belt 128 can be insufficient and/or ineffective at maintaining sheet flatness such that a portion or portions of the media can be spaced away from the transport belt 128. This can particularly occur at the edges of the media which can curl up and away from the belt 128 despite the hold down force being applied to the media 102. FIG. 2 illustrates an exaggerated view of exemplary curls 200-202 that can exist in media 102 despite the application of a hold down force by the transport belt 128. While exemplary curls 200-202 are illustrated in FIG. 2, those skilled in the art will recognize that fewer or more curls 200 may occur in the media 102 and that location of the curls 200-202 can vary. In the present example, the curl 200 can occur at the leading edge 106 of the media 102, the curl 201 can occur at the trailing edge 107, and the curl can occur in the body 108 of the media 102.

The magnitude of the curls 200-202 can be determined with respect to a reference surface or location. For example, curl magnitudes 210-212 can be determined with respect to the transport belt 128 or with respect to the media-to-marking unit gaps 220-222 that can be determined based on the space between the media and the marking units 122. The magnitude of the curls 200-202 can cause the media to interfere with the marking units and/or distort the image being disposed on the media. As one example, the curl 200 at the trailing edge of the media 102 can have a magnitude such that the media will contact the marking units 122 during the printing process and the curls 201 and 202 can such that they will not contact the marking units 122, but will affect the quality of the images printed on the media 102. To compensate for potential printing issues associated with media curl, the printing system can implement the curl control system 115 to eliminate and/or reduce media curl before the media 102 is committed to the transport belt 128.

The curl control system 115 can be implemented to mimic the operation of the transport 124 so that the curl control system 115 can identify for media curl before the media 102 enters the printing zone 126 and/or can compensate for the media curl by applying down-curl to decurl the media before the media enters the printing zone. To determine whether decurling should be applied, the system 115 can estimate the curl magnitude that the media would have in the printing zone if no decurling was applied. For example, the curl control system 115 can determine whether the media 102 would contact the marking unit 122 in the printing zone 126 and/or whether the media curl would reduce the media-to-marking unit gap or beyond a threshold value.

The curl control system 115 can estimate the curl magnitude that the media would have in the printing zone 126 if no decurling was applied by detecting the curl magnitude of the media while the media is being held down by a media transport of the curl control system 115 implemented to mimic the operation of the transport 124 of the printing station 120. If the curl control system 115 determines that decurling should be applied, the curl control system 115 can apply the down-curl to the media 102 to flatten and/or down-curl the media in preparation for transport of the media through the printing zone 126.

After decurling is performed, the curl control system 115 can check the media flatness to ensure that curl magnitudes are eliminated and/or reduced sufficiently so that the media does not contact and/or interfere with the marking units 122 and/or is flattened to mitigate print imperfections associated with media curl. If the media has been made sufficiently flattened, the media can be transported in the process direction towards the printing zone 126 under normal operation. If the media is not sufficiently flat after decurling has been applied, the curl control system 115 can perform one or more exception processes. For example, the curl control system 115 can stop the printing process and alert an operator of the media curl problem, remove the media from the transport path, bypass the printing zone 126, can decurl the media again to increase the distance between the marking units 122 and the transport belt 128 so that the media 102 can be passed through the printing zone without contacting the marking units 122, and the like.

The curl control system 115 can be implemented to ensure that the media enters the printing zone 126 sufficiently flat or down-curled so that the media 102 does not interfere with the marking units 122 and/or so that print imperfections associated with media curl are mitigated. To achieve this, the curl control system 115 gains foreknowledge of the incoming media curvature and can induce a sufficient, but not excessive, amount of down-curl to the media 102. The curl control system 115 can adjust an amount of down-curl applied to the media 102 based on the magnitude of the media curl. Excessively curled media can be difficult to hold sufficiently flat in the print zone and/or can present media handling problems in downstream subsystems of the printing system 100.

One or more of the processing devices 140 can be in communication with the marking units 122, the media transport 124, and the curl control system 115 to control the operation of the marking units 122, the media transport 124, and the curl control system 115 and to implement pre-curling and/or printing processes. The processing device(s) 140 can also interface with the non-transitory computer storage device 160.

The storage device 160 can store instructions and information for executing the pre-curling process and/or the printing process. The instructions stored by the storage device 160 can be executed by one or more of the processing devices 160 to cause the pre-curling process and/or the printing process to be implemented. The storage device 160 can be implemented using non-transient computer readable medium, such as a floppy drive, hard drive, compact disc, tape drive, Flash drive, optical drive, read only memory (ROM), random access memory (RAM), and the like.

Figure 3:
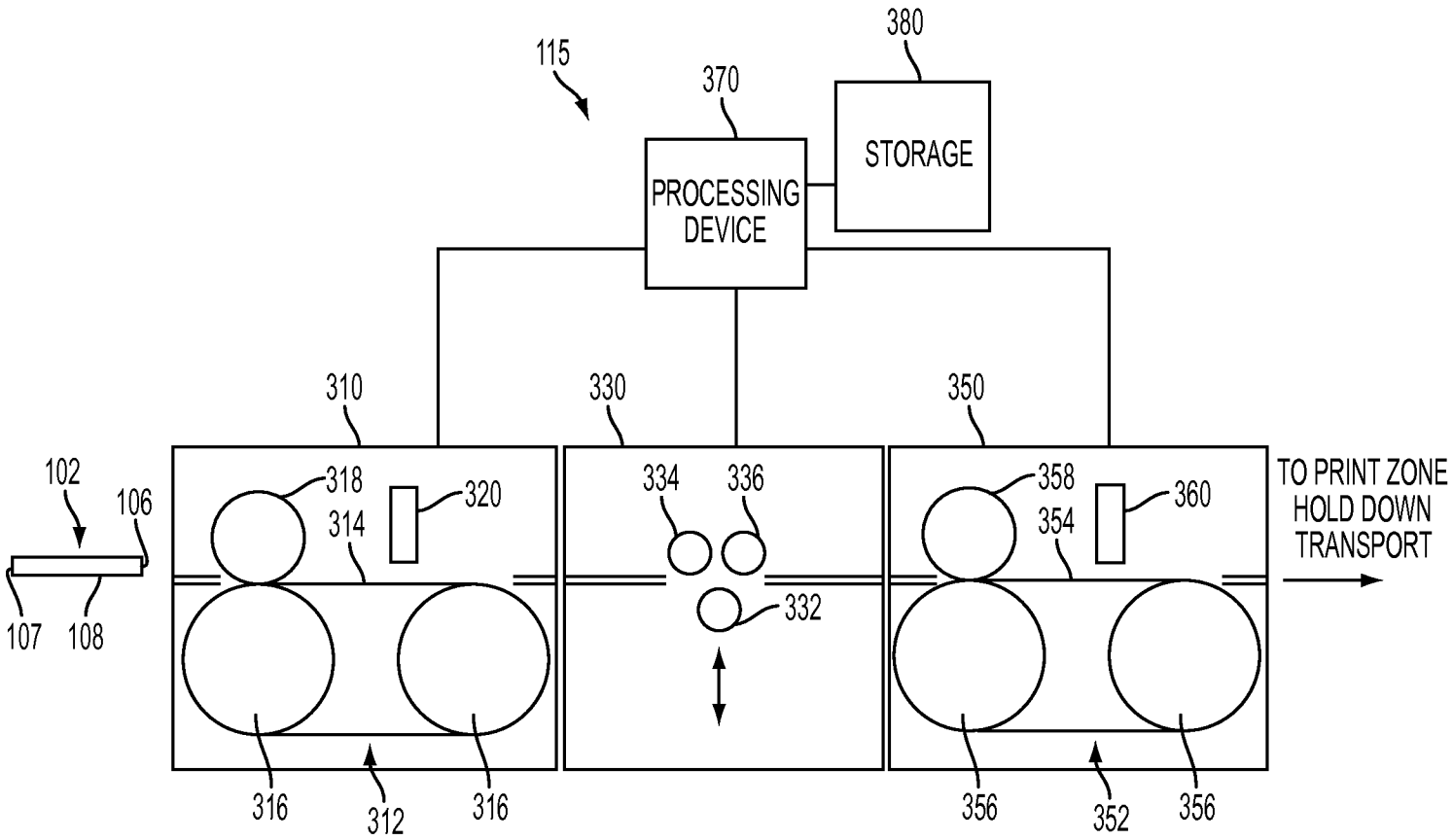
FIG. 3 shows an exemplary embodiment of a curl control system implemented in the printing system of FIG. 1.

FIG. 3 shows an exemplary embodiment of curl control system 115 (hereinafter "system 115") to flatten cut sheet substrate media 102 before the media enters the printing zone. The system 115 can include an upstream curl measurement module 310 (hereinafter "upstream module 310"), a curler 330, a processing device 370, and a computer storage device 380. In some embodiments, the processing device 370 can be implemented as one of the processing devices 140 and the storage device 380 can be implemented as the storage device 160. In some embodiments, the system 115 can include a downstream curl measurement module 350 (hereinafter "downstream module 350"). The system 115 can be implemented in a printing system in-line with the transport path of the printing system and can identify and/or compensate for media curl before the media enters a printing zone of a printing system.

The upstream module 310 can include a media hold down transport 312 and a curl sensor 320 and can predict how the media 102 will be held down in the printing zone 126 before the media is actually committed to the printing station transport belt 128. The upstream module 310 can detect media curl of the media 102 in the printing zone 126 before decurling the media 102 to eliminate and/or reduce media curl. In some embodiments, the upstream module 310 detect whether the detected media curl exceeds a threshold value. In these embodiments, if the media curl of the media 102 exceeds the threshold value, the curler 330 can apply down-curl to the media 102. If the media curl does not exceed the threshold value, the curler 330 can transport the media 102 without applying down-curl. In some embodiments, the upstream module 310 can estimate a magnitude of the media curl. In these embodiments, the curler 330 can be configured to be responsive to the estimated curl magnitude so that the curler 330 applies down-curl to the media 102 that compensates for the estimated curl magnitude without overcurling the media 102. In some embodiments, the upstream module 310 can detect whether the media curl exceeds a threshold value and can estimate the magnitude of the media curl.

The media hold down transport 312 can be implemented to mimic the media hold down transport 124 and can include a reference surface formed by driven transport belt 314 supported about rollers 316 and can include a tack roller 318 to facilitate tacking of the media 102 to the transport belt 314. The transport belt 314 uses a substantially identical hold down technology as the transport belt 128 so that the type (e.g., electrostatic or vacuum) of transport belt used in the upstream module 310 can match the type of transport belt used in the printing zone 126. The transport belt 314 can be implemented to apply a tack pressure or hold down force to a backside of media to hold the media in place. As one example, if the transport belt 128 uses electrostatic tacking to tack the media to the belt 128, the transport belt 314 uses electrostatic tacking with parameters corresponding to the parameters used by the transport belt 128. As another example, if the transport belt 128 uses vacuum pressure to tack the media to the transport belt 128, the transport belt 314 uses vacuum pressure with parameters corresponding to the parameters used by the transport belt 128.

The transport 312 can be configured using parameters that substantially match parameters used to configure the printing station transport 124 so that, for example, the hold down force applied to the media 102 in the upstream module is substantially equivalent or equivalent to the hold down force applied to the media 102 in the printing zone 126. In this manner, the media 102 experiences a substantially identical or identical hold down force on both of the transport belts 128 and 314. Thus, the flatness of the media in the upstream module 310 will be about the same as the flatness the media in the printing zone 126 if no decurling is applied. As a result, the magnitude of the media curl on the transport belt 314 can be an estimation of the magnitude of the media curl on the transport belt 128 if decurling is not applied to the media 102 by the curler 330.

The curl sensor 320 can detect the media curl of media 102 as the media 102 is transported through the upstream module 310. In some embodiments, the curl sensor 320 can be configured to detect whether the media 102 has a media curl that exceeds a threshold value and/or can detect a magnitude of the media curl. As one example, the curl sensor 320 can be configured as an infrared transmitter and receiver pair disposed at a predetermined height from the transport belt 314 such that a beam of infrared radiation propagates from the transmitter to the receiver in the cross process direction. When a media curl interrupts or blocks the beam from reaching the receiver, the curl sensor can generate a curl signal indicating that the magnitude of the media curl exceeds the height at which the beam propagates. As another example, the curl sensor can include an array of transmitter/receiver pairs positioned in an ascending order away from the transport belt 314 to form a "light curtain" so that the magnitude of the media curl determines which sensors detect the media curl. As other examples, the curl sensor 320 can be implemented as one or more proximity sensors, reflective sensors, acoustic sensors, a set of discrete mechanical flags, and the like.

The curl sensor 320 can generate a curl signal for each media curl it detects for the media 102 so that a curl signal can be generated for media curls detected, for example, at the lead edge 106, the trail edge 107, and/or the body of the media 102. Curl position information can be included in the curl signal, which can be used to configure the curler 330. For example, if a media curl is detected at the lead edge 106 of the media 102, the curl signal can include a value representing the magnitude of the media curl and a value indicating that the media curl is located at the lead edge. In response, the curler 330 can be configured to apply down-curl to the lead edge 106 of the media 102, but not to the remainder of the media 102. As another example, if a media curl is detected at the lead edge 106 and trail edge 107 of the media 102, a curl signal is generated for each media curl, where one curl signal can include a value representing the magnitude of the media curl and a value indicating that the media curl is located at the lead edge 106 and the other curl signal can include a value representing the magnitude of the media curl and a value indicating that the media curl is located at the trail edge 107. In response, the curler 330 can be configured to apply down-curl to the lead edge 106 and trail edge 107 of the media 102, but not to the body 108 of the media 102.

The curler 330 can receive the media 102 from the upstream module 310 and can decurl the media 102 to eliminate and/or reduce the media curl detected by the upstream module 310. The curler 330 can be configured to be responsive to the curl signal generated by the upstream module 310 to determine whether to decurl the media 102 and/or to determine an amount of down-curl to apply when decurling the media to adjust for the magnitude of the media curl detected by the upstream module 310. For example, the amount of down-curl applied by the curler can be determined based on the magnitude of the media curl detected.

In the present embodiment, the curler 330 is formed by a series of curling rollers 332, 334, and 336. The rollers 332, 334, and 336 are arranged so that the substrate media passes between the rollers and is decurled by the rollers. For example, roller 332 can be a lower roller and rollers 334 and 336 can be upper rollers. The media 102 can pass between the upper rollers and the lower roller such that one surface of the media 102 contacts the upper rollers and another surface of the media contacts the lower roller. The rollers 332, 334, and 336 can be adjustably positioned with respect to each other to adjust the amount of down-curl applied the media 102. For example, the lower roller can be moved towards the upper rollers to increase the amount of down-curl that is applied to the media or can be moved away from the upper rollers to decrease the amount of down-curl applied to the media 102. The position of the rollers with respect to each other can be determined in response to the magnitude of the media curl detected by the upstream module 310 so that the rollers 332, 334, and 336 are reactive to the magnitude of the media curl.

The positions of the rollers 332, 334, and 336 can be predetermined to correspond to media curl magnitudes such that possible media curl magnitudes are associated with predetermined positions of the rollers so that when a particular magnitude is detected by the upstream module 310, the rollers 332, 334, and 336 are adjusted with respect to each other using stored indentation settings. For example, a look-up table can be used that associates curl magnitudes with indentation settings that determine position of the rollers with respect to each other to compensate for the curl magnitudes. The curl magnitude can be obtained from the upstream module 310 and can be used to look up the corresponding indentation settings. Subsequently, the rollers 332, 334, and 336 can be adjusted to correspond to the indentation settings corresponding to the curl magnitude in the look up table. In some embodiments, the indentation setting can also be a function of the nominal media basis weight as well as other parameters associated with the media 102 and/or printing system 100. While the curler 330 has been illustrated using the exemplary rollers 332, 334, and 336, those skilled in the art will recognize that other arrangements and implementations of the curler 330 are possible.

The downstream module 350 can include a media hold down transport 352 and a curl sensor 360. The downstream module 350 can detect media curl of media 102 after the media passes through the curler 330 to eliminate and/or reduce media curl. The downstream module 350 can confirm that the media 102 exiting the curler 330 can be flattened sufficiently so that the media 102 can enter the printing zone 126 under normal operation. If it cannot, exception processing can be invoked to, for example, stop the printing process and alerting an operator of the media curl problem, remove the media from the transport path, bypass the printing zone 126 with the media 102, reapply decurling to the media 102, increase the distance between the marking units 122 and the transport belt 128 so that the media 102 can be passed through the printing zone without contacting the marking units 122, and the like.

The media hold down transport 352 can be implemented to mimic the media hold down transport 124. The media hold down transport 352 can include reference surface formed by a driven transport belt 354 supported about rollers 356 and a tack roller 358 to facilitate tacking of the media 102 to the transport belt 354. The transport belt 354 uses a substantially identical hold down technology as the transport belt 128 so that the type (e.g., electrostatic or vacuum) of transport belt used in the downstream module can match the type of transport belt used in the printing zone. The transport belt 354 can be implemented to apply a tack pressure or hold down force to a backside of media to hold the media in place. As one example, if the transport belt 128 uses electrostatic tacking to tack the media 102 to the belt 128, the transport belt 354 uses electrostatic tacking with parameters corresponding to the parameters used by the transport belt 128. As another example, if the transport belt 128 uses vacuum pressure to tack the media to the transport belt 128, the transport belt 354 uses vacuum pressure with parameters corresponding to the parameters used by the transport belt 128.

The transport belt 354 can be configured using parameters that substantially match parameters used to configure the print transport belt 128 so that, for example, the hold down force applied to the media 102 in the downstream module 350 is substantially equivalent or equivalent to the hold down force applied to the media 102 in the printing zone 126. In this manner, the media 102 experiences a substantially identical or identical hold down force on both of the transport belts 128 and 354. Thus, the flatness of the media 102 in the downstream module 350 will be about the same as the flatness the media 102 in the printing zone 126 after pre-curling is applied. As a result, the magnitude of the media curl on the transport belt 354 can be an estimation of the magnitude of the media curl on the transport belt 128 after pr-curling is applied to the media 102 by the curler 330. The downstream module 350 predicts how media 102 will be held down in the printing zone 126 before the media is actually committed to the transport belt 128.

In some embodiments, the curl control system can include a media loopback path that is able to route a media sheet from the output of the curler 330 back to the input of the upstream module 310 so that the upstream module can confirm that the media 102 exiting the curler 330 can be flattened sufficiently for media 102 entry to the printing zone 126 under normal operation. If it cannot, exception processing can be invoked to, for example, stop the printing process and alerting an operator of the media curl problem, remove the media from the transport path, bypass the printing zone 126 with the media 102, reapply decurling to the media 102, increase the distance between the marking units 122 and the transport belt 128 so that the media 102 can be passed through the printing zone without contacting the marking units 122, and the like. In these embodiments, the downstream module may or may not be implemented.

The computer storage device 380 can store indentation settings 382 to configure the curler 330 in response to the media curl detected by the upstream module 310. For example, the computer storage device 380 can include a look up table, database, and the like, identifying roller positions for the rollers 332, 334, and 336 based on magnitude of the media curl detected by the upstream module 310 as well as the media basis weight and/or other parameters. The storage 360 can also include a pre-curling process 384 that can be executed by the processing device 370 to decurl the media 102 by the curl control system 115.

The processing device 370 can interface with the upstream module 310, curler 350, downstream module 350, and the storage 380, as well as other components. The processing device 370 can execute the instruction in storage 380 to implement the pre-curling process 384 and can use the indentation settings 382 stored in the storage 380 to configure the curler to decurl the media 102 in response to the upstream curl signal generated by the upstream module 310. For example, the upstream module 310 can transmit the upstream curl signal to the processing device 370 and the processing device 370 can use the upstream curl signal to retrieve the indentation settings 382 corresponding to the magnitude of the media curl represented by the curl signal. Once the processing device 370 retrieves the indentation settings, the processing device 370 can apply the indentation settings 382 to the curler 330 to adjust the position of the rollers 332, 334, and 336 with respect to each other so that an appropriate amount of down-curl is applied to the media 102 so that the media curl is reduced and/or eliminated.

Figure 4:
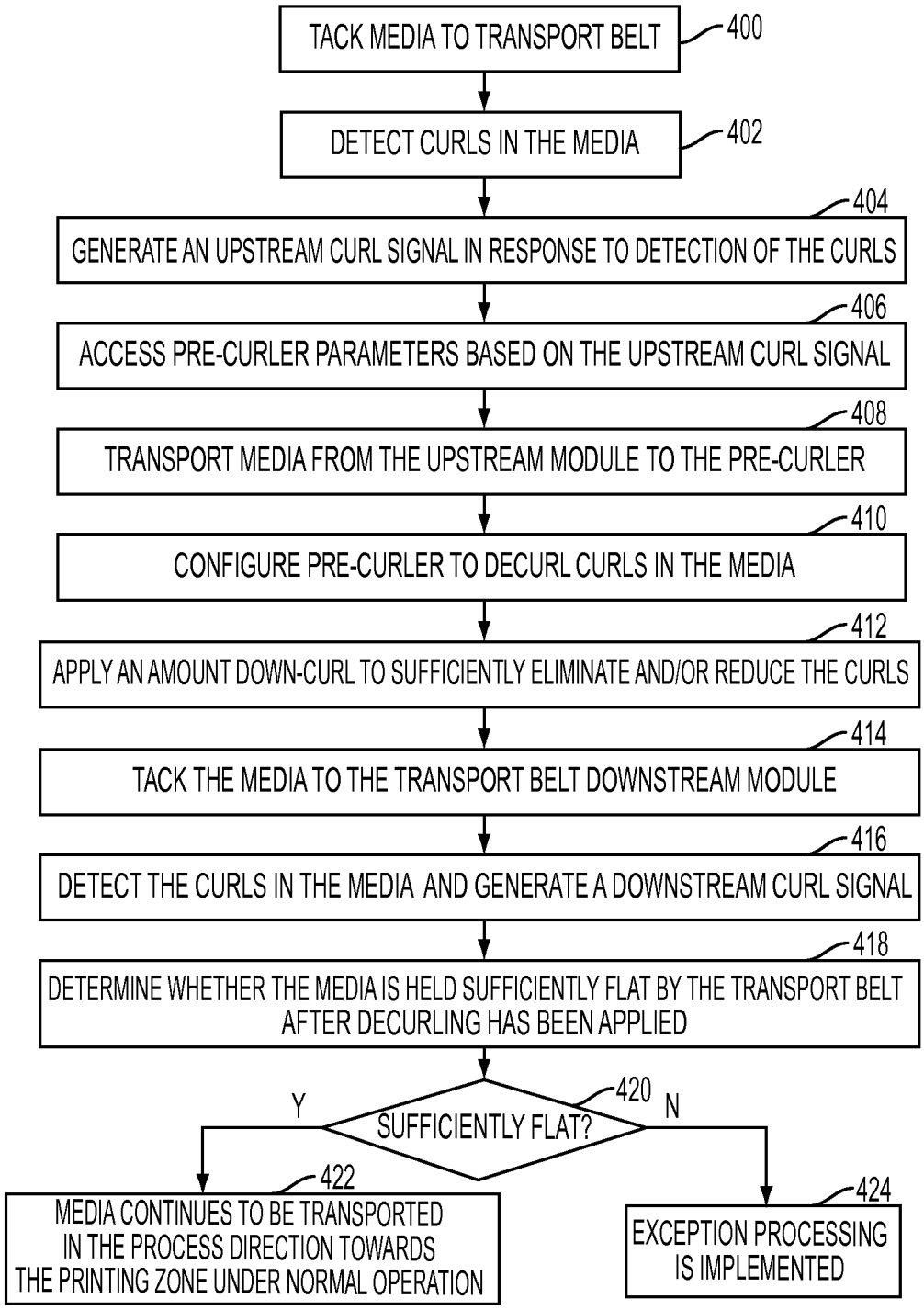
FIG. 4 is flowchart illustrating an exemplary process for pre-curling cut sheet substrate media.

FIG. 4 is an exemplary pre-curling process that can be implemented by embodiments of the curl control system. Cut sheet substrate media 102 can enter the upstream module 310 and can be tacked to the transport belt 314 (400). The media 102 can be transported past curl sensor 320, which can detect one or more curls in the media 102 that are not flattened by the hold down force applied to the media by the transport belt 314 (402). The curl sensor 320 can be configured to generate an upstream curl signal in response to detection of a media curl (404). The upstream curl signal can represent a magnitude of the media curl detected by the sensor and/or a location on the media 102 at which the curl exists (e.g., lead edge, trail edge, on the body). The upstream curl signal can be received by the processing device 370, which accesses curler parameters, such as indentation settings from the storage device 380 based on the upstream curl signal, for example, by comparing a value included in the upstream curl signal to values of a look up table and identifying the corresponding curler parameters (406).

The media 102 can be transported from the upstream module 310 to the curler 330 (408), which can be configured by the processing device 370 using the curler parameters retrieved from the storage device 380 (410). The curler 330 can be configured to apply an amount down-curl to sufficiently eliminate and/or reduce the media curl detected by the upstream module 310 (412). The media 102 can exit the curler 330 and enter the downstream module 350, which can tack the media 102 to the transport belt 354 (414). The media can be transported passed the downstream curl sensor 360, which can detect media curl of the media 102 and generate a downstream curl signal (416). The downstream curl sensor 360 can transmit the downstream curl signal to the processing device 370, which can determine whether the media 102 is held sufficiently flat by the transport belt 354 after decurling has been applied (418). If the media 102 is held sufficiently flat by the transport belt 354 (420), it is an indication that the media will be held flat by the transport belt 128 in the printing zone 126 and the media 102 continues to be transported in the process direction towards the printing zone 126 under normal operation (422). However, if the media 102 is not held sufficiently flat (420), it is an indication that the media will not be held sufficiently flat by the transport belt 128 in the printing zone 126 and exception processing is implemented (424). Exception processing can include, for example, stopping the printing process and alerting an operator of the media curl problem, removing the media from the transport path, bypassing the printing zone 126 with the media 102, reapplying decurling to the media 102, increasing the distance between the marking units 122 and the transport belt 128 so that the media 102 can be passed through the printing zone without contacting the marking units 122, and the like.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A printing system comprising an upstream measurement module including a first transport configured to generate a first hold down force to tack and flatten a media thereon and a first curl sensor to generate a first curl signal corresponding to a media curl of the media on the first transport, wherein the media is flat if there is no more than a 0.1 mm local flatness variation in the media;

a curler downstream of the upstream measurement module to curl the media in response to the first curl signal to mitigate an effect of the media curl in the printing system;

a downstream measurement module downstream of the curler, the downstream measurement module including a second transport separate from the first transport on which media is tacked to flatten the media subsequent to the media being processed by the curler and a second curl sensor to generate a second curl signal corresponding to the media curl of the media on the second transport;

a printing station downstream of the curler and the downstream measurement module, the print station including a third transport to transport the media past the printing station, the media being tacked to the third transport by a tack pressure or a hold pressure similar to that generated by the second transport; and a computer storage device to store a plurality of possible curl magnitudes and a plurality of corresponding indentation settings, the plurality of corresponding indentation settings being used to configure the curler when one of the plurality of possible curl magnitudes are detected.

2. The system of claim 1, wherein the first hold down force applied is substantially equivalent to a second hold down force generated by the second transport and applied to the media so that media flatness as indicated by a magnitude of the media curl of the media on the first transport flattened by the first hold down force estimates media flatness as indicated by a magnitude of a media curl of the media on the second transport flattened by the second hold down force.

3. The system of claim 1, wherein the first curl signal includes information corresponding to the magnitude of the media curl on the first transport and the second curl signal includes information corresponding to the magnitude of the media curl on the second transport.

4. The system of claim 1, wherein the curler applies a downcurl to the media that is determined based on the magnitude of the media curl on the first transport.

5. The system of claim 1, further comprising a processing device to configure the curler by retrieving a first one of the indentation settings from the computer storage device and applying the first one of the indentation settings to the curler in response to the first curl signal.

6. The system of claim 1, wherein the third transport generates a third hold down force applied to the media that is substantially equivalent to the second hold down force generated by the second transport and applied to the media so that media flatness of the media as indicated by the media curl on the third transport estimates media flatness of the media as indicated by the media curl on the second transport.

7. The system of claim 1, wherein the downstream measurement module implements exception processing when it is determined that a height of the media curl exceeds a threshold value, the exception processing including one or more of the following: alerting an operator of media curl problems, bypassing a printing zone, reapplying decurling to the media, and increasing a distance between one or more marking units of the printing zone and the third transport greater than the detected media curl via movement of the marking units.

8. The system of claim 1 wherein the first hold down force is selectively controllable.

9. The system of claim 1, wherein the third transport comprises selectively at least one of the following: a belt, a platen, a cam, and a nip.

10. The system of claim 1, wherein the third transport is separate from the first and second transports.

11. A curl control system for use in a printing system, the curl control system comprising:

a first transport on which a media is tacked to flatten the media, the first transport comprising selectively at least one of the following: a roller, a cam, and a nip;

a first curl sensor to generate a first curl signal corresponding to a magnitude of a media curl of the media on the first transport;

a curler to curl the media to change the magnitude of the media curl in response to the first curl signal;

a downstream measurement module downstream of the curler, the downstream measurement module including a second transport separate from the first transport on which media is tacked to flatten the media subsequent to the media being processed by the curler and a second curl sensor to generate a second curl signal corresponding to the media curl of the media on the second transport; and a computer storage device to store a plurality of possible curl magnitudes and a plurality of corresponding indentation settings, the plurality of corresponding indentation setting being used to configure the curler when one of the plurality of possible curl magnitudes are detected, wherein the first transport is configured to generate a first hold down force to tack and flatten the media down, the first hold down force substantially equivalent to a second hold down force generated by the second transport of a printing station downstream of the first transport.

12. The system of claim 11, wherein the curler applies a downcurl to the media that is determined based on the magnitude of the media curl on the first transport.

13. The system of claim 11, wherein the second transport is configured to generate a second hold down force comparable to the first hold down force implemented by the first transport.

14. The system of claim 11, further comprising a processing device to configure the curler by retrieving a first one of the indentation settings from the computer storage device and applying the first one of the indentation settings to the curler in response to the first curl signal.

15. The system of claim 14 wherein the media is flat if there is no more than a 0.5 mm local flatness variation in the media.

16. The system of claim 11 wherein the first hold down force is selectively controllable.

17. The system of claim 11 wherein the first transport is a transport belt and the first hold down technology is electrostatic force.

18. A method of pre-curling substrate media in a printing system comprising:

tacking a media to a first transport to flatten the media on the first transport, the first transport comprising a cam;

generating a first curl signal to represent a magnitude of a media curl of the media on the first transport;

curling the media to change the magnitude of the media curl in response to the first curl signal;

tacking the media to a second transport separate from the first transport to flatten the media subsequent to the media being curled;

generating a second curl signal corresponding to a magnitude of the media curl on the second transport; and tacking the media to a third transport to transport the media past a printing station, wherein the first transport generates a first hold down force that is substantially equivalent or equivalent to a second hold down force generated by the second transport so that media flatness of the media as indicated by a magnitude of the media curl on the first transport flattened by the first hold down force estimates media flatness as indicated by a magnitude of a media curl of the media on the second transport flattened by the second hold down force after decurling of the media by the curler.

19. The method of claim 18, further comprising:

tacking the media to the third transport separate from the first transport and the second transport after the media is processed by the curler and before the media enters a printing zone, the third transport generating a third hold down force that is substantially equivalent to the second hold down force generated by the second transport so that media flatness as indicated by the magnitude of the media curl of the media on the third transport flattened by the third hold down force estimates media flatness as indicated by a magnitude of the media curl of the media on the second transport flattened by the second hold down force due to the substantial equivalence of the second hold down force and the third hold down force; and generating a second curl signal corresponding to the media curl of the media on the second transport.

20. The method of claim 19, further comprising:

executing exception processing when it is determined that the media curl has not been reduced sufficiently in response to the second curl signal, the exception processing including one or more of the following: alerting an operator of media curl problems, bypassing the printing zone, and reapplying decurling to the media.

* * * * *